United States Patent [19]

Sartori

[11] Patent Number: 4,606,091

[45] Date of Patent: Aug. 19, 1986

[54] METHOD FOR THE EMBODIMENT OF BROOMS, BRUSHES AND SIMILAR ARTICLES, AND A BROOM OR BRUSH OBTAINED THEREWITH

[76] Inventor: Francesco Sartori, Via San Felice, 44 - 40122 Bologna, Italy

[21] Appl. No.: 743,921

[22] Filed: Jun. 12, 1985

[30] Foreign Application Priority Data

Nov. 30, 1984 [IT] Italy ..... 5127/84[U]

[51] Int. Cl.[4] ..... A46B 9/02

[52] U.S. Cl. ..... 15/195; 15/159 R; 15/160; 300/17; 300/21

[58] Field of Search ..... 15/159 R, 160, 191 R, 15/191 A, 192, 193, 194, 195, 196, 197, 198, 199, 200, 204, 205, DIG. 5; 300/3, 6, 17, 21

[56] References Cited

U.S. PATENT DOCUMENTS 551,994 12/1895 O'Keefe ..... 15/195
632,748 9/1849 Raymond et al. ..... 15/195
3,402,413 9/1968 Gibellina ..... 15/160 X

FOREIGN PATENT DOCUMENTS 506945 6/1939 United Kingdom ..... 15/160

*Primary Examiner*—Peter Feldman
*Attorney, Agent, or Firm*—Laff, Whitesel, Conte & Saret

[57] ABSTRACT

The method disclosed envisages embodiment of a solid back carrying tufts of bristles or fibers etc which is provided, at least along the stretches near its outermost ends, with a series of sloping lands having an angle of inclination that is progressively less accentuated the nearer a single land is located to the middle section of the surface on which it is formed. Each land is provided with a corresponding hole whose axis is disposed normal or substantially normal to the land, whilst the remaining part of the surface is provided with uniformly-distributed holes the axes of which are either normal or marginally inclined relative to the surface itself. At least one tuft is set into each hole in such a way that the projecting tips of the bristles or fibers lie within a common plane.

12 Claims, 8 Drawing Figures

α
α1
L'
D''
X
1
1a
2
3
31
4
5
6
7
8

METHOD FOR THE EMBODIMENT OF BROOMS, BRUSHES AND SIMILAR ARTICLES, AND A BROOM OR BRUSH OBTAINED THEREWITH

BACKGROUND of the INVENTION

The invention relates to the manufacture of brooms, brushes and similar articles utilized for household or general sweeping and cleaning.

Conventional manufacture of such cleaning aids, at industrial level, envisages the embodiment of a solid back which carries small bunches either of natural bristles or of synthetic fibers, known as tufts, and permits of attaching a staff or handle for ultimate use, by hand, of the finished article.

Such backs are generally flat, though in some embodiments may either exhibit curved or bent-upward longitudinal ends, or be curved through their entire length, as illustrated in FIGS. 1, 2 and 3, and are provided with stopped holes distributed uniformly over the surface opposite that to which the handle is attached.

The holes thus produced accommodate tufts of fibers. Such fibers, of a given selected type, are bunched together into small bundles approximately twice the length X (FIG. 1) of the formed tuft which ultimately projects from the back of the finished broomhead, the bundle of fibers being bent double into a U thereby providing a fold by means of which to facilitate insertion of the tuft into a corresponding hole offered by the back. Drilling of holes in the back and insertion of the tufts therein are operations accomplished by locating the back in a three-dimensional pantograph-type copying jig which permits movement about a fulcrum coincident with the axis passing through the center of the back, and located at a point distanced from the side to which the handle is ultimately attached. In this way it becomes possible to produce holes in the solid back that are angled with respect to the surface from which the tufts project, in such a way as to fan out the pattern of the tufts, at least toward the outer ends of the back.

Such fanning-out of the tuft pattern performs two functions: first, that of increasing the overall length of contact L between the fibers and the surface to be swept, in relation to the length of the back; and second, that of permitting access to tight corners and skirtings when sweeping, without any obstruction from the back of the broomhead itself.

The prior art makes provision, when utilizing flat backs of the type illustrated in FIG. 1, either for rounding-off or beveling the ends, which permits only a limited fan-out of the tuft pattern however, as maneuver of the back relative to the tool during drilling is possible only in a very limited measure. The drill bits are in fact unable to penetrate a surface sharply angled relative to their own axis, and must be safeguarded from the risk of breakage caused through excessive bending stress. The result is that the distance D between the outermost ends of the back and the tips of the outer tufts (which project from the outermost ends of the back) is often insufficient to ensure that the back of the broomhead will not itself constitute an obstruction to efficient sweeping of tight corners and skirtings.

In an attempt to improve the situation thus described, use has been made of backs as illustrated in FIGS. 2 and 3 of the drawings. In these instances however, the overall length of contact L between the fibers and the surface to be swept is shortened, by reason of the fact that the tips of the outer tufts are raised from the surface on which tufts located along the middle section of the back come to rest. At all events, the distance D between the outermost ends of the back and the tips of the outer tufts is barely greater than the distance D as illustrated in FIG. 1, and as such, is insufficient to provide an effective solution to the problem of sweeping tight corners and skirtings.

Studying the type of relative movement with which a brush or broom back is usually invested when drilling holes and subsequently inserting the tufts (bristle or synthetic fiber), the applicant observes that, were the back to be provided with a series of flat, concave or convex angled surfaces, along the longitudinal stretches nearest the outermost ends at least, such as will offer points of contact lying at right angles to the drill-bits and tufting tools in any given location, it would be possible to embody a broomhead, for example, wherein the tufts projecting from the solid back could be fanned out to a notable degree. Furthermore, the applicant observes that by inserting tufts of greater length into these holes located near the outermost ends of the back, than those inserted into the uniformly-distributed holes of the middle section, one obtains a broomhead which in addition to exhibiting a notably fanned-out tuft pattern, is embodied such that the tips of all the tufted bristles or fibers may lie within a common plane. The combined effect of these two techniques would be such as to permit embodiment of a broom capable of affording the optimum solution to those problems described above.

SUMMARY of the INVENTION

In the light of the foregoing observations, the applicant discloses a method for making brooms, brushes and similar articles, comprising these essential steps:

providing a solid back which carries tufted fibers and exhibits a surface, at the opposite side to that where a handle is ultimately attached, providing at least along the stretches nearest to its outermost ends a series of sloping lands which create a acute angle with said surface and of which the inclination relative to the surface becomes progressively less accentuated The nearer the land is located to the middle section of the solid back; forming in each sloping land holes or seats the axis of which are disposed substantially normal to the land; and forming, in the remaining part of the said said surface, uniformly distributed holes or seats, inserting tufted fibers of desired length in the holes of the sloping lands, and in the holes of the middle section of the same said surface, and providing the tips of all the tufted fibers lie in a common plane.

In a preferred version of the method as disclosed herein, the tips of all the tufts inserted into the back are trimmed by shaving, to the end of aligning the tips of the tufted fibers to a greater degree of precision within the common plane aforesaid; also, the shaving operation is carried out in such a way as to ensure that the plane lies parallel to the surface from which the tufts project.

In a first variation of the method, by means of which it is sought to incline the handle of the broom with respect to the vertical, thereby affording advantage to the user in certain circumstances, shaving is carried out in such a way that the plane in which the tips of tufted fibers are caused to lie will be angled in relation to the surface from which the tufts project.

In a second variation of the method, the angle of the sloping lands is such that each single land, viewed from one side, lies substantially normal to a straight line that connects it with a fulcrum point about which the back is rotated for the purposes of drilling holes and inserting tufted fibers, in order to facilitate such operations as far as is possible by ensuring the absence of bending stresses on the drill bits or tufting tools, regardless of the angle to which the back is ultimately rotated about such a fulcrum point.

BRIEF DESCRIPTION of the DRAWINGS

The method disclosed herein and the broom or brush obtained therewith will now be described in detail, by way strictly of example, with the aid of the accompanying drawings, in which.

DESCRIPTION of the PREFERRED METHOD & EMBODIMENTS

Figure 5:
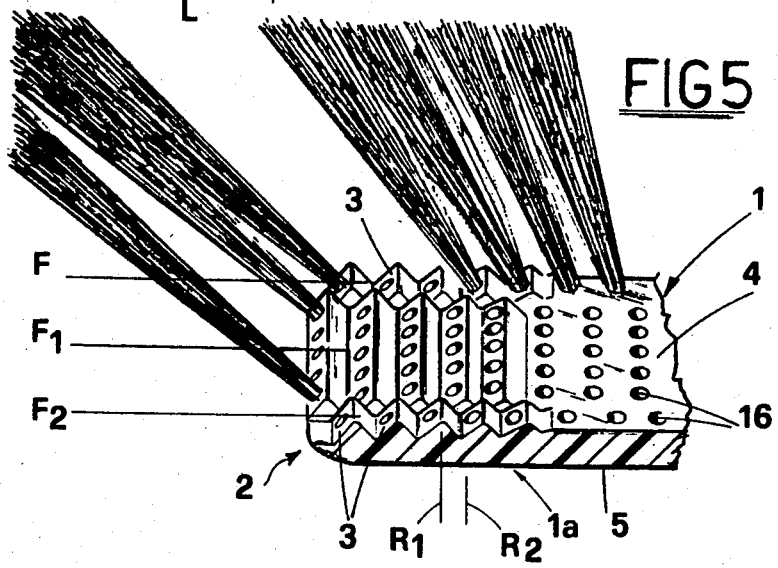
FIGS. 5 and 8 are schematic representations, viewed in perspective from one side, of two alternative embodiments of a broom back obtained with the method disclosed herein.
Figures 4, 6:
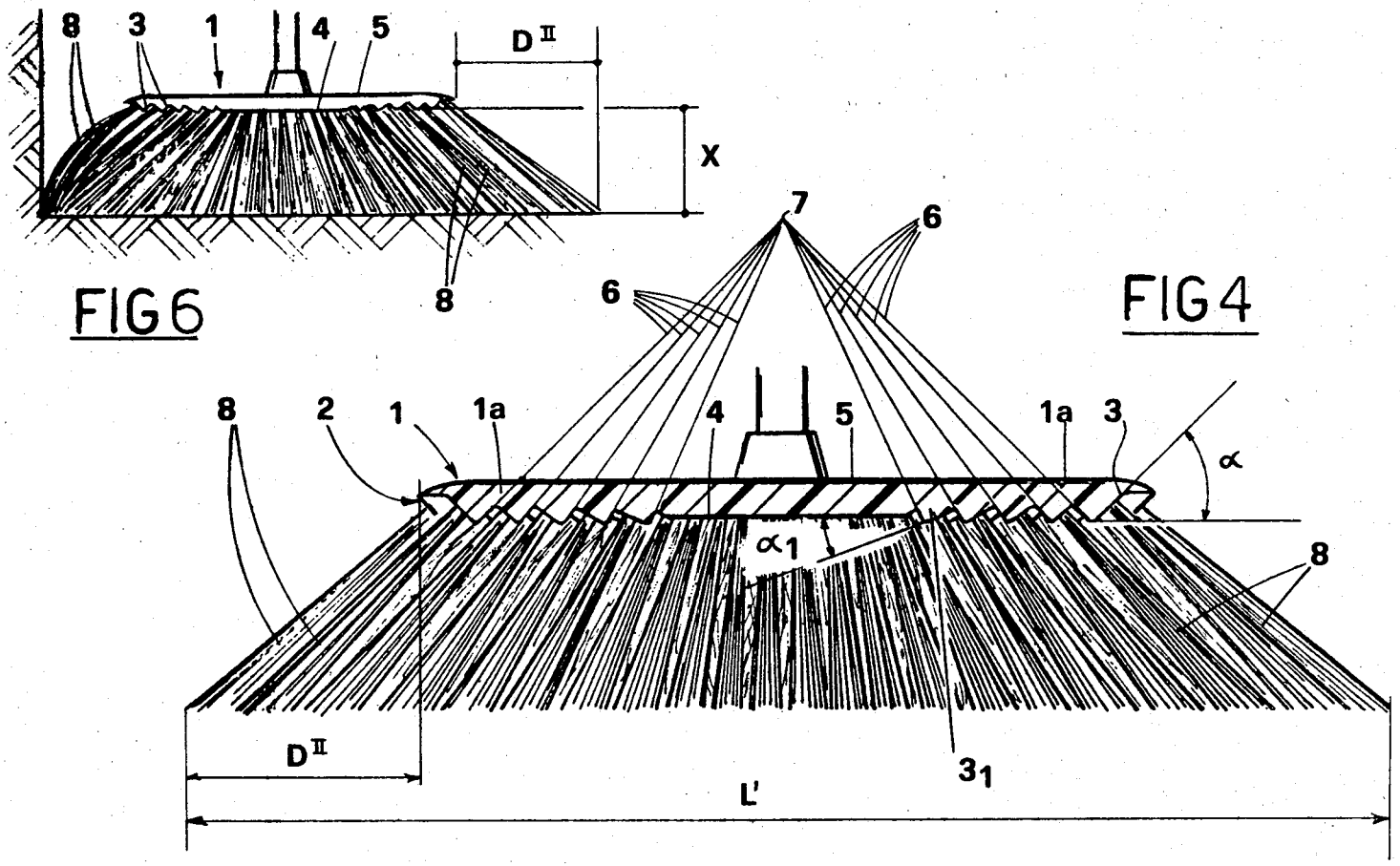
FIG. 4 is the schematic representation, viewed from one side and in cutaway, of a broomhead obtained with the method disclosed herein.
FIG. 6 is the schematic representation of a special effect obtainable in practical application, showing a broom obtained with the method disclosed herein.

Referring to FIGS. 4 and 5, the solid back 1 of a broom- or brush-head according to the invention has stretches 1*a* nearest the outermost ends 2 which exhibit a series of sloping lands 3 formed on the surface 4 opposite the surface 5 which connects with the staff, or handle (not denoted in the drawings).

These lands 3 form an acute angle $\alpha$ with the surface 4 of the back 1, which diminishes progressively the nearer the single land 3 is located to the middle section of the back 1, hence to that part of the surface 4 exhibiting no lands. For example, the angle denoted $\alpha^1$ descriptive of the land $3_1$ in FIG. 4 located nearest the middle section of the surface 4, is much narrower than the angle $\alpha$ descriptive of the land 3 located at the outermost end of the back 1.

As FIG. 5 illustrates, the lands 3 are formed on the surface 4 in a number of files denoted F, $F_1$ and $F_2$ which lie parallel to the longitudinal median directrix of the solid back 1, and are disposed in ranks $R_1$, $R_2$ lying normal to the same directrix.

Observing the finished broomhead, it will be seen that such an arrangement allows tufting of the surface 4 to maximum possible capacity; viewing the broom from one side, practically no voids will be discernable between the various tufts making up the broomhead.

In a preferred version of the method, the angle of the lands 3 is determined such that each single land lies substantially normal to a straight line 6 connecting it with a fulcrum point 7 about which the solid back 1 is rotated for the purposes of drilling holes, and subsequently, of inserting tufted fibers 8 thereinto.

Embodied thus, one has the possibility when drilling the solid back 1, of offering parts of its surface 4 to the drill bits which are disposed at right angles, or substantially at right angles, to the axes of the bits themselves, thereby permitting operation of the bits without any danger of breakage occurring by reason of their being subjected to excessive bending stress. The result of this procedure is that the tufts 8, especially those toward the two outermost ends 2 of the broomhead, assume a notably fanned-out appearance such as will greatly favor an additional effect (shortly to be described) which derives from another feature of the method.

Figure 1:
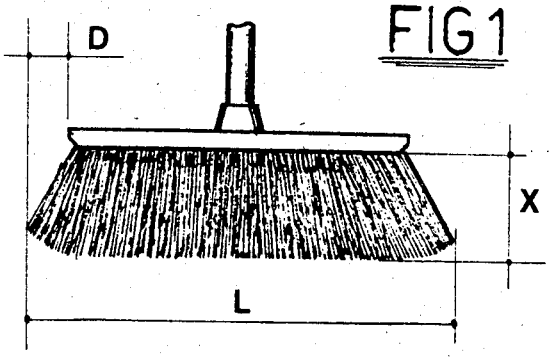
PRIOR ART FIG1
FIGS. 1, 2 & 3 illustrate broomheads obtained with prior art methods.
Figure 2:
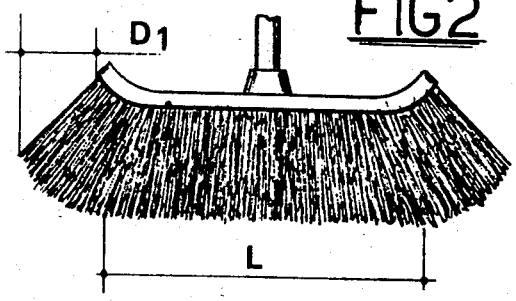
PRIOR ART FIG2
Figure 3:
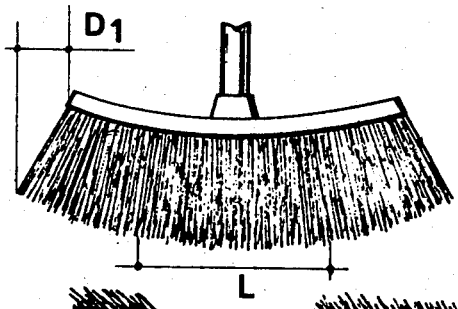
PRIOR ART FIG3

As mentioned previously in the introductory part of the application, it is important that the tips of the tufted fibers located nearest the outermost ends 2 of the back 1 be distanced considerably from these ends to facilitate the sweeping of tight corners and skirtings. In the method according to the invention, fibers to be inserted in the holes 16 drilled in the lands 3 are selected such that the length of the tufts 8 in one rank differs from that of the tufts in the next. In this way one obtains a distance $D_1$ between the tips of the outer tufts 8 and the outermost ends 2 of the back 1 much greater than the equivalent distance D or $D_1$ illustrated in FIGS. 1, 2 and 3, taking the length X of bristles or fibers utilized in prior art methods of embodiment as par, and the objects that the invention sets out to achieve are amply realized.

A result of this second effect is that one obtains an overall length of contact L' between the fibers and the surface to be swept that is considerably greater than the length of the solid back 1 of the broomhead, an advantage inasmuch as one is provided with an implement (be it broom or brush) more effective in ultimate use than similar types obtainable with prior art methods.

In order to ensure optimum coplanarity of the tips of tufted fibers in practical application of the method, the applicant envisages utilization of two distinct fiber lengths, the shorter serving for tufts in the middle section of the surface 4. Longer fibers will be trimmed back during the final stages of the broomhead's assembly. This operation permits of trimming back the tips of all the tufts into a plane parallel with surface 4 (or indeed angled with respect thereto, should the requirement be for a broom whose handle will slant naturally toward the user with the fibers resting on the ground).

Referring to FIG. 6, it will be seen that a favorable effect is undoubtedly produced in sweeping tight corners and/or skirtings, utilizing a broom embodied according to the invention, since by urging the broom into such corners or skirtings, the outer tufts 8 are deflected in such a way as to be forced increasingly into the corner or skirting and sweep that much more efficiently as a result.

In practical application the sloping lands 3 may be angled with respect to a directrix disposed transversely to the surface 4 of the solid back 1, distributed uniformly or otherwise on the stretches 1*a* concerned, and exhibit either one or more holes in which to insert the tufted bristles or fibers 8. Moreover, the solid back 1 might exhibit any one of a variety of shapes and forms, even for the purpose of appearances alone; for instance, the stretches 1*a* nearest the two outermost ends 2 might be embodied with sloping lands 3 of dimensions such as to form, substantially, a single curved plane as illustrated in FIGS. 7 and 8.

Again, the lands 3 could be angled relative to the transverse dimension of the solid back 1, in which case it will be the outermost lands once more that exhibit the more accentuated inclinations. What is more, the stretches 1*a* provided with lands might be bent upwards, profiled, or curved in any fashion whatever.

Figure 8:
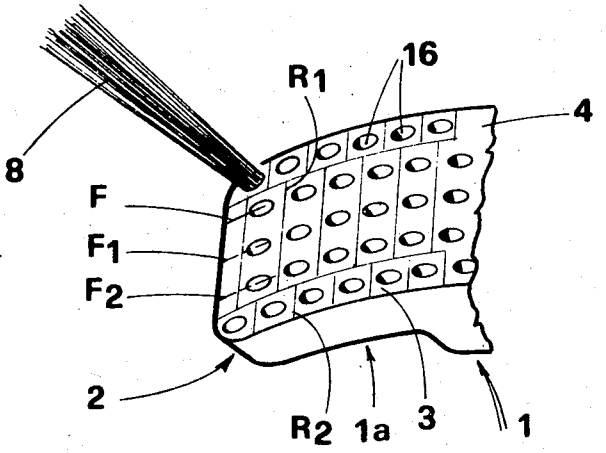
Figure 7:
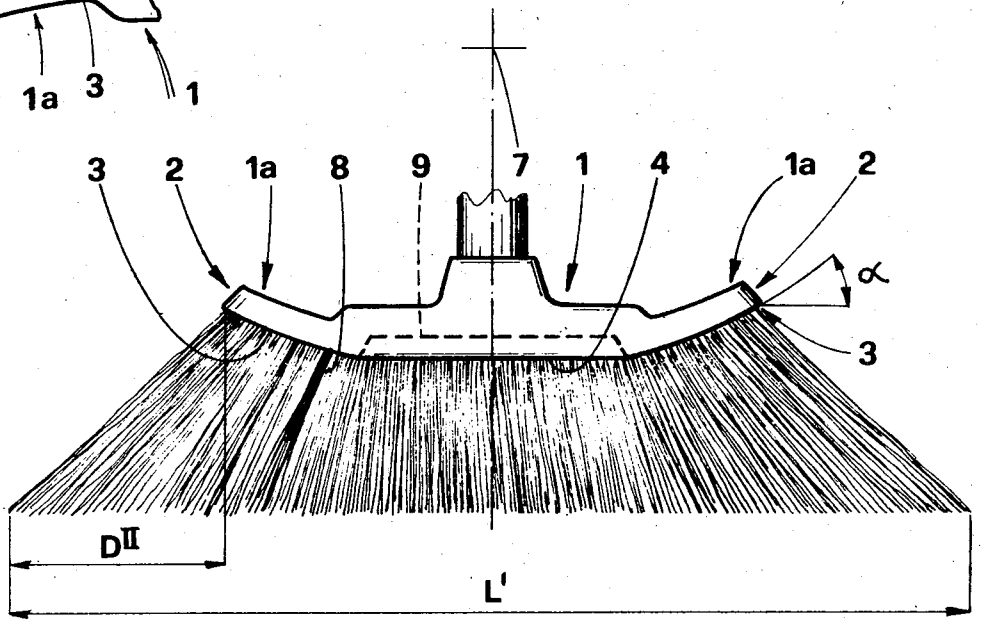
FIG. 7 is a schematic representation, viewed from one side, of a broom incorporating a back the embodiment of which is a variation on that of FIG. 4.

Referring still to FIGS. 7 and 8, the back 1 may be provided at the middle section of its bottom surface 4 with a sunken stretch 9 such as will allow exploitation of a longer length of tufted fiber 8 as well as reduce waste in trimming. The fact of being able to utilize tufts of a certain length, in the sunken stretch at least, will ensure the embodiment of a broom possessing greater flexibility and, as a result, enhanced sweeping efficiency.

Likewise at this middle section of the bottom surface 4 of the solid back 1, the holes 16, and by definition, the tufts 8, may be disposed perpendicular to the longitudinal plane, or alternatively, may be disposed such as to center on the fulcrum point denoted 7, thereby ensuring improved, more uniform distribution of the tips of the fibers.

In practical application, the back 1 of the broom or brush may be embodied in any appropriate material whatever, and the lands could be incorporated either during a molding stage (were the back to be fashioned in plastic) or by subsequent machining. The lands themselves might be embodied, furthermore, with flat, convex, or concave surfaces.

What is claimed:

1. A Method for making, brushes and similar articles, comprising the following essential steps:

providing a solid back which carries tufted fibers and exhibits a surface, at the opposite side to that where a handle is ultimately attached, providing at least along the stretches nearest to its outermost ends a series of sloping lands which create an acute angle with said surface and of which the inclination relative to the surface becomes progressively less accentuated the nearer the land is located to the middle section of the solid back;

forming in each sloping land holes or seats the axis of which are disposed substantially normal to the land; and forming, in the remaining part of the same said surface, uniformly distributed holes or seats, inserting tufted fibers of desired length in the holes of the sloping lands, and in the holes of the middle section of the same said surface, and providing the tips of all the tufted fibers lie within a common plane.

2. A Method as in claim 1, comprising shaving the projecting ends of all tufts thus inserted in order to trim back the tips thereof into alignment within a common plane.

3. A method as in claim 2 wherein the shaving step is carried out in such a way that the plane in which the tips of the tufts are aligned lies parallel with the bottom surface of the solid back from which the tufts project.

4. A method as in claim 2 wherein the shaving step is carried out in such a way that the plane in which the tips of the tufts are aligned is angled with respect to the bottom surface of the solid back from which the tufts project.

5. A method as in claim 1 or 2 wherein the solid back envisages arrangement of the lands in a plurality of files lying parallel to the longitudinal median directrix of the solid back, and in ranks, aligned lying at right angles to the same longitudinal directrix; and wherein the inclination of the lands is such that, viewed from the side, the single land lies substantially normal to a straight line which connects it with a fulcrum point about which the solid back may be rotated for the purposes of carrying out the steps whereby tufts are inserted into the holes or seats formed in the lands and in the remaining part of the surface from which the tufts project.

6. A broom or brush obtained by the method of claim 1, wherein the sloping lands together create a continuous curved plane.

7. A broom or brush obtained by the method of clain 5, wherein the tips of all of the tufts projecting from the solid back lie within a common plane.

8. A broom or brush obtained by the method of claim 1 wherein the tufts inserted into the holes or seats located at the stretches nearest the outermost ends of the back exhibit a fanned-out appearance with respect to the surface from which they project, whereas each single tuft is disposed substantially normal to a corresponding sloping land of flat, concave or convex profile offered by said stretches; and wherein the sloping lands create an acute angle with said surface the inclination of which becomes progressively less accentuated the nearer the land is located to the middle section of the solid back.

9. A broom or brush as in claim 8 wherein the sloping lands are embodied during an operation whereby the solid back is molded from a plastic material.

10. A broom or brush as in claim 8 wherein the solid back is substantially flat.

11. A broom or brush as in claim 8 wherein the solid back exhibits stretches nearest the outermost ends which are inclined relative to the middle section such as to create an angle of less than 180° between parts of that surface of the solid back to which the handle is attached.

12. A broom or brush as in claim 6 or 7 wherein the sloping lands are angled in relation to the transverse dimension of the solid back.

* * * * *